United States Patent [19]

Katsuoka

[11] Patent Number: 4,515,127

[45] Date of Patent: May 7, 1985

[54] FOUR-CYCLE ENGINE

[75] Inventor: Tatsuzo Katsuoka, Hamamatsu, Japan

[73] Assignee: Yamaha Hatsudoki Kabushiki Kaisha, Japan

[21] Appl. No.: 403,926

[22] Filed: Aug. 2, 1982

[30] Foreign Application Priority Data

Aug. 7, 1981 [JP] Japan ..... 56-123891

[51] Int. Cl.[3] ..... F02B 17/00

[52] U.S. Cl. ..... 123/430; 123/586; 123/80 BA; 123/190 D; 123/432

[58] Field of Search ..... 123/26, 80 BA, 188 M, 123/190 A, 190 B, 190 R, 190 D, 306, 308, 432, 52 M, 585, 586, 587, 588, 589, 429, 430; 261/23 B, 23 C

[56] References Cited

U.S. PATENT DOCUMENTS 3,948,227 4/1976 Guenther ..... 123/190 A
3,976,039 8/1976 Henault ..... 123/26
3,994,270 11/1976 Nakano et al. ..... 123/52 M
4,317,438 3/1982 Yagi et al. ..... 123/308

FOREIGN PATENT DOCUMENTS 47-27078 8/1972 Japan .
56-167767 12/1981 Japan .

*Primary Examiner*—Ira S. Lazarus
*Assistant Examiner*—R. S. Bailey
*Attorney, Agent, or Firm*—Ernest A. Beutler

[57] ABSTRACT

Several embodiments of induction systems for internal combustion engines which provide stratification with an open chamber thus eliminating the need for auxiliary chambers and obviating the need for employing fuel injection. In all embodiments, first and second intake passages communicate with the chamber and one of these intake passages delivers a substantially weaker mixture than the other. This weaker mixture is admitted during the initial intake stroke and a richer fuel/air mixture is admitted at the end of the intake stroke so as to insure the existence of a stoichiometric mixture at the spark plug at the time of firing.

8 Claims, 8 Drawing Figures

FOUR-CYCLE ENGINE

BACKGROUND OF THE INVENTION

This invention relates to a four-cycle engine and more particularly to an induction system for such an engine that is particularly adapted at achieving open chamber stratification.

It has been proposed to improve the fuel efficiency and exhaust gas emission control of an internal combustion engine by providing a stratified charge combustion process. With a stratified charge combustion process, a stoichiometric fuel/air mixture surrounds the spark plug at the time of ignition. The remainder of the chamber is, however, charged with air and/or fuel at a less than stoichiometric mixture. When the rich mixture in the vicinity of the spark plug is ignited, the remaining weak mixture will also burn due to the rapid transfer of the flame front and the increased pressure in the chamber. Thus, it is possible to operate an engine in this manner at less than full speed and load when the total chamber is charged with a less than stoichiometric mixture.

One method of achieving stratification as heretofore proposed embodies a generally open single combustion chamber in which stratification is achieved. The various methods for employing stratification with open chambers, such as the Texaco Combustion Process and other processes of this general type have required direct cylinder fuel injection. Direct fuel injection is done in such a manner and with such a timing as to achieve stratification and a rich fuel/air mixture in the vicinity of the spark plug at the time of ignition. Such devices, however, have not met any large degree of commercial success due to the high cost of the injection equipment required. Furthermore, it is very difficult with this type of arrangement to insure that the stoichiometric fuel/air patch will be in proximity to the spark gap at the time of injection.

Another method for achieving stratification employs the use of an auxiliary combustion chamber in which the spark plug is position or to which the spark plug is proximate which is charged with a richer fuel/air mixture than the remaining larger portion of the combustion chamber. With this type of engine, the rich fuel/air mixture may be delivered to the auxiliary chamber either by means of a carburetor or by means of a fuel injection system. This type of stratification, however, has several disadvantages. First, because of the use of the auxiliary combustion chamber, the total surface to volume ratio of the combustion chamber (S/V ratio) is increased and heat loss results. Furthermore, there are significant pumping losses in achieving the flow between the auxiliary and main combustion chambers. Furthermore, if a carbureted arrangement is employed, the scavenging of the auxiliary combustion chamber during the exhaust stroke may cause significant loss of fuel and air during the next intake cycle with conditions of valve overlap.

It is, therefore, a principal object of this invention to provide an improved induction system for achieving stratification in an internal combustion engine.

It is another object of this invention to provide an improved open chamber stratified internal combustion engine.

It is a further object of this invention to provide an induction system for an internal combustion engine which permits the use of a carburetor and which will still achieve stratification.

It is yet a further object of this invention to provide an improved, carbureted, stratified charge internal combustion engine wherein no fuel charge is lost due to the scavenging of the chamber.

It has been found that stratification may be achieved in an open chamber engine by providing two separate induction passages, one of which provides the chamber with a richer fuel/air mixture than the other. If the intake passages are made to communicate with the chamber at different times during the intake stroke, it is possible to achieve stratification and yet permit the use of carburetion. That is, it has been found that by providing communication of the leaner fuel/air mixture with the combustion chamber during the initial intake stroke and communication of the richer fuel/air mixture at the end of the intake stroke, it is possible to insure a rich fuel/air mixture in the vicinity of the spark plug at the time of ignition and still permit the use of carburetion and minimize the loss of fuel during scavenging.

It is another object of this invention to provide a simplified induction system which will achieve stratification of the type described.

SUMMARY OF THE INVENTION

A first feature of this invention is adapted to be embodied in an induction system for an internal combustion engine comprising a substantially open chamber of variable volume, first intake passage means for delivering a first charge to the chamber, and second intake passage means for delivering a second charge to the chamber. The charges have different mixture strength. In accordance with the invention, means communicate the intake passages with the chamber at different times during the intake cycle for stratifying the charge in the chamber.

Another feature of the invention is adapted to be embodied also in an induction system for an internal combustion engine having a variable volume chamber. An intake port serves the chamber and first and second intake passages each serve the intake port. In accordance with this feature of the invention, valving means control the communication of the intake passages with the intake port during a given intake cycle so that only one of the passages serves the intake port at the beginning of the intake cycle and the other of the passages serves the intake port at the completion of the intake cycle.

DETAILED DESCRIPTION OF THE PREFERRED EMBODIMENTS

Embodiment of FIGS. 1-5

Figure 1:
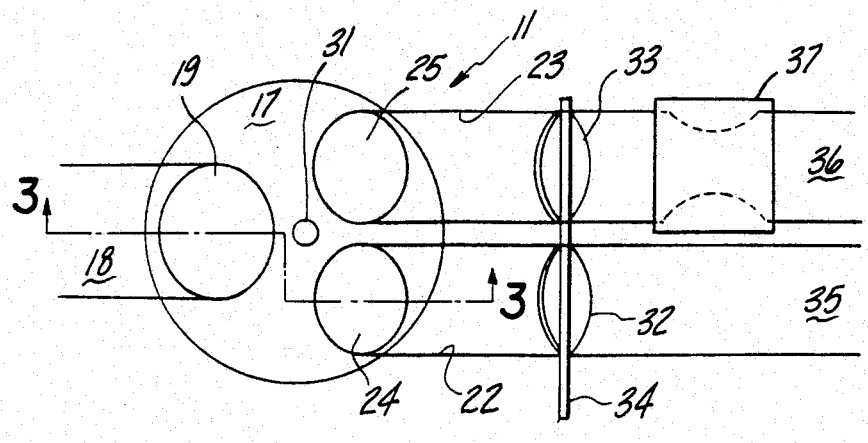
FIG. 1 is a partially schematic top plan view of a single cylinder of a four-cycle internal combustion engine constructed in accordance with this invention and shows primarily the induction system.

An internal combustion engine constructed in accordance with a first embodiment of the invention is identified generally by the reference numeral 11. The engine 11 is of the multi-cylinder type, however, only a single cylinder of the engine is illustrated. It is to be understood that the invention can be used with single cylinder engines and its application to the remaining cylinders of a multi-cylinder engine is believed to be readily apparent to those skilled in the art from the following description.

The engine 11 includes a cylinder block 12 in which cylinder bores 13 are formed. Pistons 14 are supported for reciprocation within the cylinder bores 13 and are connected to a crankshaft (not shown) by means of connecting rods 15 in a known manner.

A cylinder head 16 is affixed to the cylinder block 12 in a known manner and has a generally open recess 17 that lies above each cylinder bore 13 and which cooperates with the cylinder bore 13 and the reciprocating pistons 14 to form a chamber of volume which varies during the reciprocation of the piston. This variable volume chamber will be referred to at times as the combustion chamber.

An exhaust passage 18 extends through one side of the cylinder head 16 from the respective combustion chamber 17. The flow of exhaust gases through the exhaust passages 18 is controlled by means of an exhaust valve 19 that is operated in a known manner by means of a overhead mounted exhaust camshaft 21.

In accordance with the invention, the engine 11 is provided with a first cylinder head intake passage 22 on the side of the chamber 17 opposite the exhaust valve 19. In side-by-side relationship to the first cylinder head intake passage 22, a second cylinder head intake passage 23 is formed. Intake valves 24 and 25 control the communication of the intake passages 22 and 23, respectively, with the combustion chamber 17. The intake valves 24 and 25 are operated by respective lobes 26 and 27 of an overhead mounted intake camshaft 28.

The camshafts 21 and 28 are driven in any known manner at one-half of crankshaft speed. The camshafts 21 and 28 and associated components of the valve train are enclosed by means of a cam cover 29 that is affixed to the cylinder head 16 in a known manner.

A spark plug 31 (FIG. 1) is positioned in the cylinder head 16 generally in the center of the combustion chamber 17.

A pair of throttle valves 32 and 33 control the flow through the cylinder head intake passages 22 and 23. The throttle valves 32 and 33 are affixed to a common throttle valve shaft 34 so that they will be rotated in unison. In this embodiment, the throttle valves 32 and 33 are at the same angular position on the shaft 34.

An air intake passage 35 serves the first cylinder head intake passage 22 upstream of the throttle valve 32. In a like manner, an intake passage 36 is positioned upstream of the throttle valve 33 for serving the cylinder head intake passage 23. In accordance with this embodiment, a charge forming device in the form of a carburetor, indicated schematically at 37, is position in the intake passage 36 so that a fuel/air mixture will be delivered to the second cylinder head intake passage 23.

Figure 2:
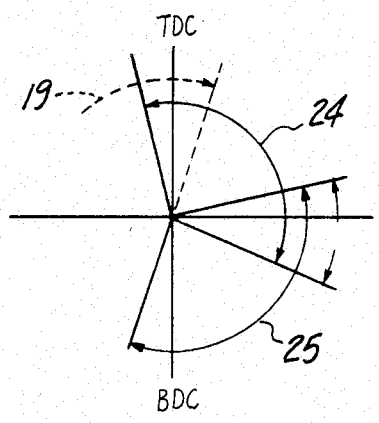
FIG. 2 is a diagram indicating the valve timing of the embodiment of FIG. 1.

As has been noted, different lobes 26, 27 of the camshaft 28 are provided for operating the respective intake valves 24 and 25. In accordance with the invention, the valve sequence is such that the intake valve 24 will be opened during the initial portion of the intake stroke so as to draw a pure air charge into the combustion chamber 17. Toward the middle of the intake stroke, the intake valve 25 is opened so as to draw a fuel/air mixture into the chamber which will be stratified and positioned adjacent the spark plug 31 at the time of ignition. FIG. 2 is a diagramatic view showing the valve timing of the invention.

Referring now to FIG. 2, the final closing stage of the exhaust valve 19 is indicated by the appropriate broken line. As is common, the exhaust valve 19 does not fully close until after the piston reaches top dead center at the completion of the exhaust stroke and is still open during the initial stage of the intake stroke. With conventional stratified charge engines embodying auxiliary chambers and scavenging, this means that a portion of the rich fuel/air mixture drawn into the auxiliary combustion chamber may escape from the exhaust valve when it is still open during the beginning of the intake stroke. This, therefore, gives rise to poor fuel economy with conventional engines.

The timing of the opening of the intake valve 24 is indicated by the appropriate arrow in FIG. 2. It should be noted that the intake valve 24 is opened by the cam lobe 26 prior to the piston 14 having reached top dead center at the completion of the exhaust stroke and this opening is maintained during a substantial portion of the intake stroke of the engine. Since only pure air is inducted through the intake valve 24, the overlap between its opening and the closing of the exhaust valve 19 will not result in the loss of any unburned fuel from the exhaust valve and will further improve scavanging of the engine.

The intake valve 25 is opened by the cam lobe 27 sometime after the piston 14 begins its intake stroke as shown by the appropriate arrow in FIG. 2. In accordance with this embodiment of the invention, there is an overlap between the opening of the intake valves 24 and 25 as indicated by the area A in FIG. 2. Eventually the intake valve 24 will close and only the intake valve 25 will be opened so that a rich fuel/air mixture will be delivered to the chamber only through the intake passage 23.

Figure 3:
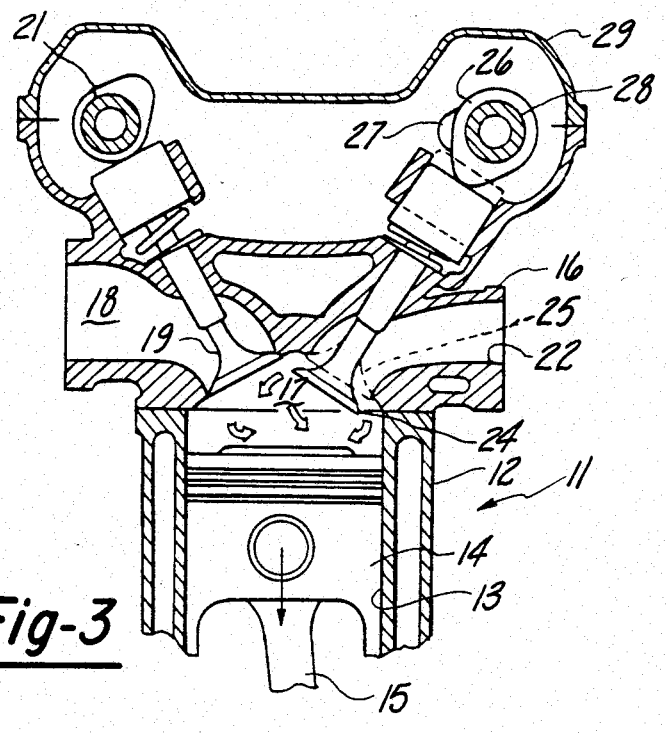
FIG. 3 is a cross-sectional view taken along the line 3—3 of FIG. 1 and shows the engine during the beginning of the intake cycle.
Figure 4:
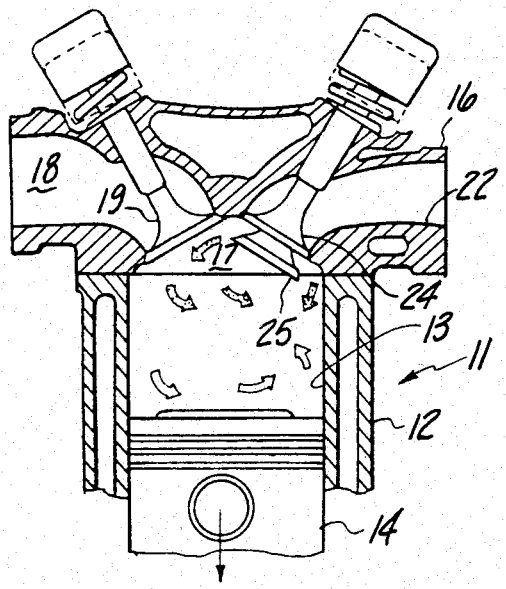
FIG. 4 is a cross-sectional, in part similar to FIG. 3, and shows the engine during the end of the intake cycle.
Figure 5:
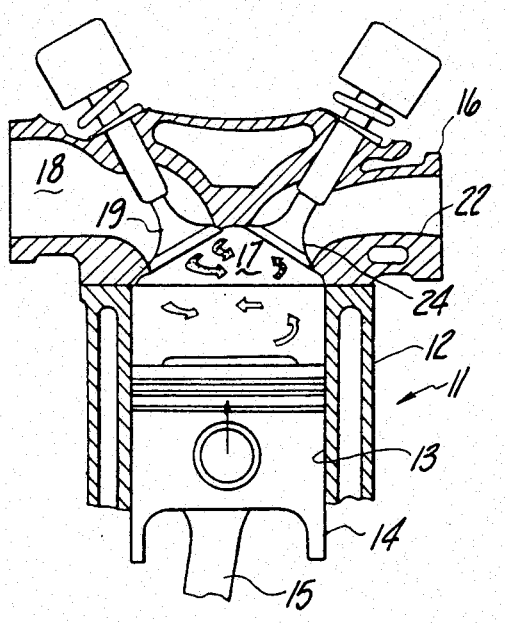
FIG. 5 is a cross-sectional view, in part similar to FIGS. 3 and 4, showing the engine as it appears during the beginning of the compression stroke.

The operation of the invention of this embodiment may be best understood by reference to FIGS. 3 and 4. During the initial intake stroke, the intake valve 24 will be opened and an intake charge of pure air from the intake passages 22 and 35 will be drawn into the combustion chamber 17 as indicated by the open arrows in these figures. As has been noted, any overlap between the opening of the exhaust valve 19 and the intake valve 24 will, therefore, not result in the loss of any fuel through the exhaust valve 19 as a result of this valve overlap. As the piston 14 reaches an intermediate position in its intake stroke, the intake valve 25 will open and a fuel/air mixture will be admitted to the chamber 17. During the initial stage of this opening, both valves 24 and 25 will be opened and there will be both pure air and fuel/air mixture admitted to the engine. At the completion of the intake stroke, however, the intake valve 24 will be closed and only a rich fuel/air mixture will be admitted to the chamber 17 through the intake valve 25 (FIG. 4) as indicated by the shaded arrows in the figures. Hence, the upper portion of the chamber 17 will be charged with a rich fuel/air mixture while the lower portion of the chamber will be charged primarily with pure air. Although there may be some mixing during the resulting compression stroke (FIG. 5), a richer fuel/air mixture which is at least stoichiometric is maintained at the top portion of the combustion chamber 17 and in proximity to the spark plug 31.

As a result, when the spark plug 31 is fired, ignition will be insured and burning will progress at a rapid but smooth rate across the combustion chamber. As a result of this and the increasing flame front pressure, the weaker fuel/air mixture at the periphery of the stoichiometric charge will also be ignited and there will be complete combustion in the chamber without unnecessary fuel wastage. As a result, both fuel economy and exhaust emission control are improved. This is true even though the total air/fuel charge in the chamber 17 at the time of ignition may be less than stiochiometric.

Figure 6:
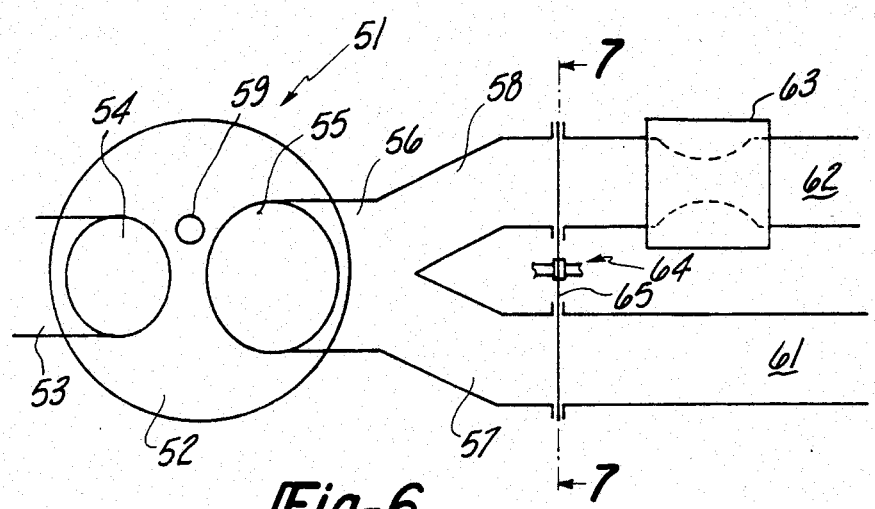
FIG. 6 is a partially schematic top plan view, in part similar to FIG. 1, showing another embodiment of the invention.
Figure 7:
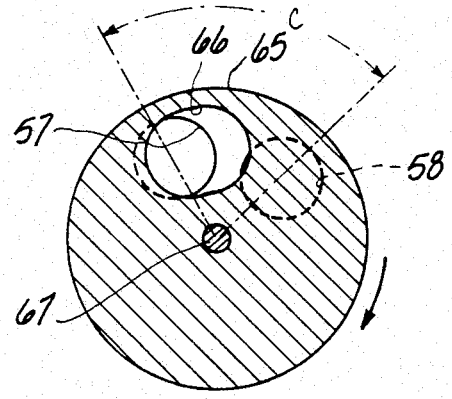
FIG. 7 is cross-sectional view taken along the line 7—7 of FIG. 6.
Figure 8:
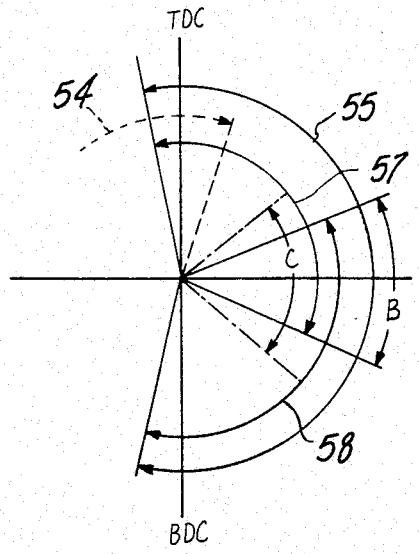
FIG. 8 is a valve timing diagram of the embodiment of FIGS. 6 and 7.

Embodiment Of FIGS. 6–8

In the preceded embodiment, the two separate intake passages serve the combustion chamber through separate intake valves. The invention, however, may be used in conjunction with an arrangement wherein the two intake passages serve the same chamber through a common intake valve. Such an embodiment is shown in FIGS. 6 through 8 wherein an internal combustion engine constructed in accordance with this embodiment is identified generally by the reference numeral 51. The engine 51 includes a cylinder block, cylinder head and piston which have not been shown in detail in this embodiment but which define a combustion chamber 52 of generally open configuration.

An exhaust passage 53 that is controlled by an exhaust valve 54 is formed in the cylinder head for exhausting combustion products from the combustion chamber 52. In this embodiment, the cylinder head is provided with a single intake valve 55 which is supplied by a cylinder head intake passage 56 having a first branch 57 and a second branch 58. As with the previously described embodiment, a spark plug 59 is positioned in the cylinder head in general proximity to the center of the combustion chamber 52.

The cylinder head intake branches 57 and 58 are served by respective first and second intake passages 61 and 62. As with the previously described embodiment, the passage 61 supplies pure air whereas the passage 62 supplies a carbureted fuel/air mixture from a carburetor, indicated schematically at 63.

Communication of the passages 61 and 62 with the branches 57 and 58 is controlled by means of a rotary valve assembly, indicated generally by the reference numeral 64 and including a valve disk 65. The valve disk 65 has an arcuate aperture 66 and is rotatable about an axis of rotation, indicated at 67. The center of the cylinder head intake passages 57 and 58 are disposed at an angle indicated by the dimension C in FIG. 7 about the axis 67 and equidistant from it. As noted in this figure, the valve plate opening 66 is sufficiently large so as to cause some overlap in its registry with the passages 57 and 58. The valve disk 65 is rotated at a speed equal to the speed of the crankshaft by means of any suitable driving arrangement.

FIG. 8 illustrates the valve timing of this embodiment. As with the previously described embodiment, the exhaust valve 54 is maintained in an opened condition as indicated by the broken line to a point slightly after the piston reaches its top dead center at the completion of the exhaust stroke and has begun its downward movement during the intake stroke. Slightly before the piston begins its downward movement and while it is still travelling upward on the exhaust stroke, the intake valve 55 opens and the intake passage 57 is opened due to the registry of the valve plate aperture 66 with this passage. The total intake valve opening is shown by the line 55 in FIG. 6.

As the valve disk 65 continues to rotate, the passage 57 will be maintained open for a period of time and a charge of pure air will be drawn into the combustion chamber 52 as with the previously described embodiment. Eventually, the aperture 66 will register with both passages 57 and 58 and a fuel/air mixture from the passage 62 will then be delivered into the passage 58 and the combustion chamber 52. This condition is shown by the overlap B in FIG. 8.

Eventually the aperture 66 will no longer register with the passage 57 and only the passage 58 will serve the chamber 52. Thus, a rich stiochiometric fuel/air mixture will be delivered to the chamber 52 at the completion of the intake stroke and, as with the previously described embodiment, this rich fuel/air mixture will be in proximity to the spark gap at the time of ignition. Hence, it is possible to achieve combustion even though the total fuel/air mixture in the chamber 52 is less than stiochiometric.

It has been noted that the valve disk 65 is driven at crankshaft speed. This means that it will open communication between the passages 61 and 62 and the passages 57 and 58 during each rotation of the crankshaft whereas the valve 55 is opened only on alternate rotations due to the half speed driving of its camshaft. The opening of the communication etween the passages 61 and 62 and the passages 57 and 58 at such times when the intake valve 55 is not opened will not have any effect and, hence, this condition is not undesirable. If desired, however, the valve disk 65 may be rotated at camshaft speed.

In the illustrated embodiment, the cylinder head intake passages 57 and 58 are located at equal radial distances from the center of rotation 67 of the valve disk 65 so that a single aperture 66 could control the flow through both passages. It is to be understood, of course, that an arrangement may be provided wherein these distances are not equal and separate apertures in the valve disk 65 control the opening and closing of the respective passages. Such an arrangement may give rise to a greater latitude in control over the relationship of the openings. In any event, it is desirable to insure that the passage 57 begins to open at substantially the same time or before the opening of the intake valve 55 and that the passage 58 is closed at substantially the same time or later than the closing of the intake valve 55.

It should be readily apparent that the described embodiments provide an arrangement wherein stratification is possible by means of a carbureted engine embodying an open combustion chamber without the necessity for using auxiliary chambers. In addition, the loss of fuel due to valve overlap is prevented. In the illustrated embodiments, the first intake passages are supplied with pure air. It is to be understood that a fuel/air mixture may be supplied through these passages, however, it is believed preferable to supply pure air. For this reason, when the term "charge" is used in the specification and claims and the term "different mixture strengths" is used, it is intended to include an arrangement wherein only pure air is delivered through the first intake passages or a weaker fuel/air mixture is delivered through these passages than through the second intake passage. In all events, it is insured that there will be a rich or stiochiometric fuel/air mixture in the vicinity of the spark plug at the time of ignition. Various other changes and modifications may be made without departing from the spirit and scope of the invention, as defined by the appended claims.

I claim:

1. In an induction system for an internal combustion engine comprising a substantially open chamber of variable volume, first intake passage means for delivering a first charge to said chamber, and second intake passage means for delivering a second charge to said chamber, at least one of said intake passage means terminating at a poppet valve for controlling the flow into said open chamber, said charges having different mixture strengths, the improvement comprising means communicating said intake passage means with said chamber through a single intake port and single poppet type intake valve at different times during the intake cycle with the leaner charge being delivered to said chamber only during the initial portion of the intake cycle and the richer charge being delivered only at the ending portion of the intake cycle for stratifying the charge in said chamber.

2. In an induction system as claimed in claim 1 wherein the means for communicating the intake passage means with the chamber achieves stratification of the fuel/air mixture in the chamber during the compression stroke.

3. In an induction system as claimed in claim 2 wherein the stratification is achieved by valving means for controlling the communication of the intake passage means with the intake port.

4. In an induction system as claimed in claim 3 wherein the valving means comprises a rotary valve.

5. In an induction system as claimed in any of claims 2 through 4 wherein a carburetor supplies a fuel/air charge to the second intake passage means.

6. In an induction system as claimed in claim 5 wherein the first intake passage means delivers a pure air charge to the chamber.

7. In an induction system as claimed in any of claims 2 through 4 wherein the first intake passage means delivers a pure air charge to the chamber.

8. In an induction system for an internal combustion engine having a substantially open variable volume chamber, an intake port serving said chamber, a poppet type intake valve controlling the flow through said intake port, a first intake passage serving said intake port and a second intake passage serving said intake port, the improvement comprising valving means for controlling the communication of said intake passages with said intake port during a given intake cycle so that only one of said passages serve said intake port at the beginning of said intake cycle and only the other of said passages serves said intake port at the completion of the intake cycle.

* * * * *